United States Patent [19]

Wieland

[11] Patent Number: 4,938,135

[45] Date of Patent: Jul. 3, 1990

[54] PLATE CLAMPING ASSEMBLY

[75] Inventor: Erich G. Wieland, Würzburg, Fed. Rep. of Germany

[73] Assignee: Koenig & Bauer Aktiengesellschaft, Würzburg, Fed. Rep. of Germany

[21] Appl. No.: 243,844

[22] Filed: Sep. 13, 1988

[30] Foreign Application Priority Data

Sep. 21, 1987 [DE] Fed. Rep. of Germany ..... 3731684

[51] Int. Cl.[5] ..... B41F 13/16; B41F 27/12

[52] U.S. Cl. ..... 101/415.1; 101/378

[58] Field of Search ..... 101/415.1, 378, 383, 101/DIG. 12

[56] References Cited

U.S. PATENT DOCUMENTS

| | | | |
|---|---|---|---|
| 3,824,928 | 7/1974 | Langer | 101/415.1 |
| 3,991,677 | 11/1976 | Barnes | 101/415.1 X |
| 4,061,087 | 12/1977 | Hill | 101/415.1 |
| 4,408,529 | 10/1983 | Johne et al. | 101/415.1 |
| 4,408,531 | 10/1983 | Okamura et al. | 101/415.1 |
| 4,577,560 | 3/1986 | Banike | 101/415.1 |
| 4,688,483 | 8/1987 | Schollenberger | 101/415.1 |
| 4,712,476 | 12/1987 | Jeschke | 101/415.1 |
| 4,748,911 | 6/1988 | Kobler | 101/378 |
| 4,864,931 | 9/1989 | Felkl et al. | 101/415.1 |

FOREIGN PATENT DOCUMENTS 893343 9/1953 Fed. Rep. of Germany .

*Primary Examiner*—Edgar S. Burr
*Assistant Examiner*—Moshe J. Cohen
*Attorney, Agent, or Firm*—Jones, Tullar & Cooper

[57] ABSTRACT

A plate clamping assembly for securing a printing plate to a plate cylinder of a rotary printing machine utilizes spaced clamping bars which are each pivotably positioned in a groove in the plate cylinder. An axially slidable and rotatable shaft cooperates with one of the clamping bars while an axially fixed and rotatable adjusting shaft cooperates with the other clamping bar. Both adjusting shafts having a plurality of truncated cones which engage tappet arms on the clamping bars.

5 Claims, 2 Drawing Sheets

PLATE CLAMPING ASSEMBLY

FIELD OF THE INVENTION

The present invention is directed generally to a printing plate clamping assembly. More particularly, the present invention is directed to a printing plate clamping assembly for the positive clamping of a printing plate on a plate cylinder of a rotary printing press. Most specifically, the present invention is directed to a plate clamping assembly for positively clamping and skewing a printing plate on a plate cylinder of a rotary printing press. The plate cylinder has an axially extending groove which carries clamping bars. These clamping bars are pivotably and axially slidably disposed in the plate cylinder grooves and have printing plate engaging clamping slots. An adjusting shaft is utilized for pivotable movement of each of the clamping bars and these adjusting shafts carry truncated cones which act as cams for the clamping bars.

DESCRIPTION OF THE PRIOR ART

Printing plate clamping devices are generally known in the art. These clamping devices are used to securely position printing plates on the surface of plate cylinders in rotary printing presses. It is typically necessary to be able to clamp the printing plate to the surface of the plate cylinder and to also be able to adjust the position of the printing plate on the surface of the print cylinder. Such positioning may take the form of an axial shifting of the plate on the cylinder, a skewing of the plate on the cylinder, or a combination of these where the printing plate must be shifted axially and skewed. Furthermore, it may also be necessary to adjust the circumferential position of the printing plate on the plate cylinder.

One prior plate clamping device is shown in German Patent No. 893,343. This assembly allows a plate to be skewed on the surface of a plate cylinder. Plate skewing in this prior art device requires an assembly mounted in a rather large groove in the plate cylinder. This groove may take up approximately one fourth of the circumference of the plate cylinder and thus eliminated a substantial amount of plate cylinder surface area that could otherwise be used for printing. This large groove width is necessitated by the structure of the adjusting devices which are all carried in the cylinder groove. The plate cylinder clamping device disclosed in this prior art patent does not provide for axial or circumferential adjustable positioning of the printing plate on the plate cylinder.

The prior art plate clamping assemblies have been apt not to be able to provide axial, circumferential and skew adjustments for a printing plate on a plate cylinder of a rotary printing machine in an assembly which does not significantly reduce the available printing surface on the face of the plate cylinder. The plate clamping assembly in accordance with the present invention provides such a device and is a substantial advance in the art.

SUMMARY OF THE INVENTION

It is an object of the present invention to provide a plate clamping assembly.

A further object of the present invention is to provide a plate clamping assembly for clamping a printing plate.

Another object of the present invention is to provide a plate clamping assembly for clamping a printing plate on a plate cylinder of a rotary printing press.

Yet a further object of the present invention is to provide a plate clamping assembly which allows the plate to be positioned axially on the plate cylinder.

Still another object of the present invention is to provide a plate clamping assembly which will clamp a plate on a plate cylinder so that the plate can be shifted axially and skewed.

Even yet a further object of the present invention is to provide a plate clamping assembly which is durable and rugged.

As will be discussed in greater detail in the description of the preferred embodiment which is set forth subsequently, the plate clamping assembly in accordance with the present invention utilizes a pair of plate nd clamping bars which are placed generally parallel to each other in an axially extending groove in a plate cylinder. Each of these plate clamping bars is axially shiftable and is also pivotably mounted in the groove. Each clamping bar has a cooperating adjusting shaft with one of these shafts also being axially shiftable. Each adjusting shaft carries a plurality of truncated cones which engage tappet arms on the clamping bars. These truncated cones are eccentrically secured to the adjusting shafts with respect to the axes of these shafts. Thus axial shifting of the adjusting shaft effects a skewing of the printing plate, rotation of the adjusting shafts effects plate clamping, and axial shifting of the clamping bars effects lateral registration of the printing plate.

The plate clamping assembly of the present invention can be housed in a relatively narrow groove in the periphery of the plate cylinder. This means that the effective printing area of the plate cylinder is greater than has been the situation when the prior art devices have been used. This plate clamping assembly is also usable with printing plate cylinders that are rotatable in both forward and reverse directions.

The plate clamping assembly in accordance with the present invention affords both a axial or lateral adjustment of the printing plate position and a skew adjustment of the plate. These adjustments can be accomplished quickly and accurately using much lens printing cylinder space than were required by prior devices. Thus the printing plate clamping assembly in accordance with the present invention is a significant advance in the art.

DESCRIPTION OF THE DRAWINGS

While the novel features of the plate clamping assembly in accordance with the present invention are set forth with particularity in the appended claims, a full and complete understanding of the invention may be had by referring to the description of the preferred embodiment which is presented subsequently, and as illustrated in the accompanying drawings, in which:

DESCRIPTION OF THE PREFERRED EMBODIMENT

Figure 1:
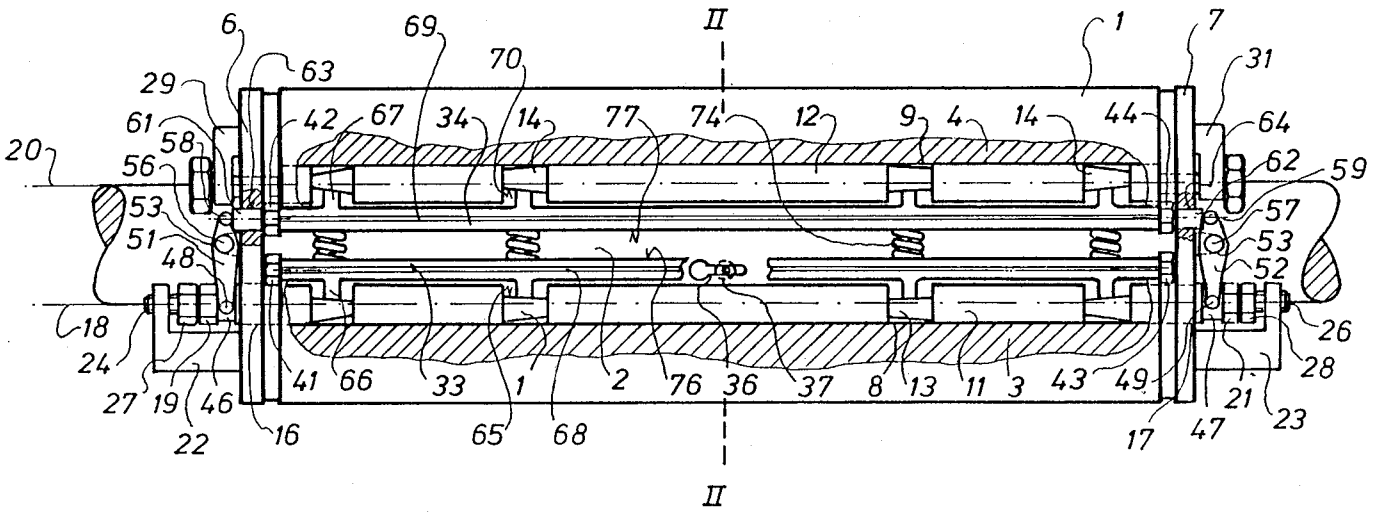
FIG. 1 is a top plan view of the printing plate clamping assembly of the present invention.

Referring initially to FIG. 1 there is shown generally at 1 a printing plate cylinder which is provided with the printing plate clamping assembly in accordance with the present invention. This plate clamping assembly is positioned generally in a groove 2 which extends axially along the periphery of plate cylinder 1. This groove 2 is limited at its ends by spacing bearer rings 6 and 7 which are placed at the left and right ends, respectively of printing plate cylinder 1, as viewed in FIG. 1.

Figure 2:
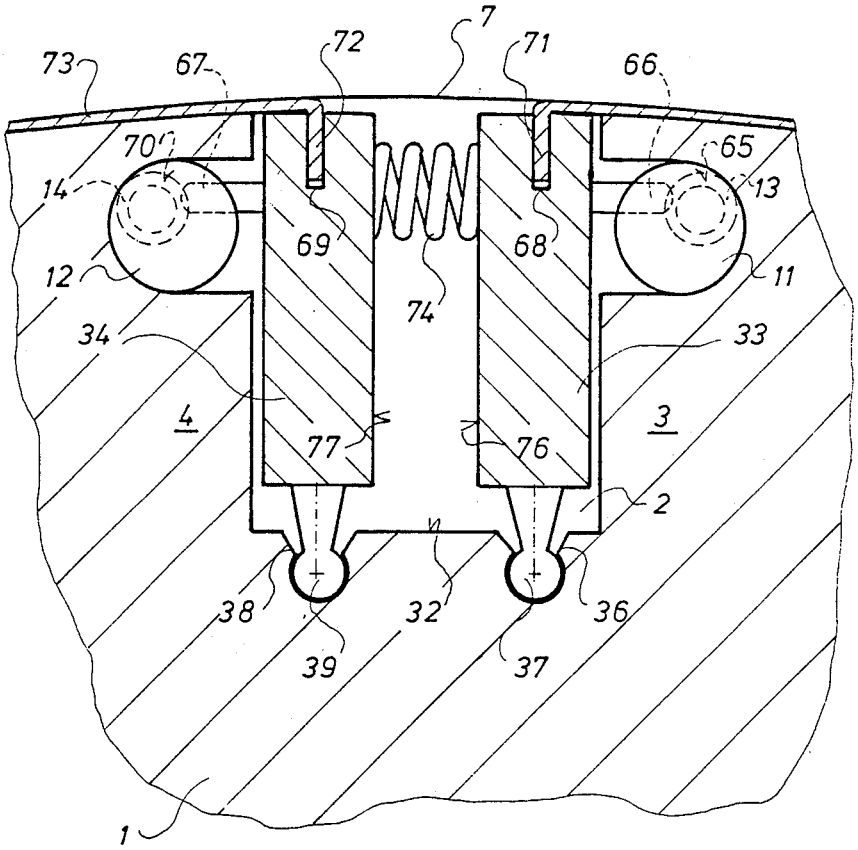
FIG. 2 is a sectional side elevation view of the plate clamping assembly of the present invention and taken along line II—II of FIG. 1.

Axially extending groove 2, as may be seen most clearly in FIG. 2 includes groove sidewalls 3 and 4, and a groove bottom 32. An axially extending slot 8 is formed in groove sidewall 3 and a corresponding slot 9 is formed in groove sidewall 4. Each of these slots, 8 and 9 extend between the bearer rings 6 and 7 and each of the slots carries a rotatable adjusting shaft, 1 and 12. respectively. Each of the adjusting shafts 1 and 12 carry a plurality of axially spaced truncated arms 13 and 14, respectively which are positioned in the bodies of shafts 11 and 12 eccentrically to the axes of rotation 18 and 20 of shafts 11 and 12, respectively.

An adjusting shaft 11 is axially slidable in bores 16 and 17 in the bearing rings 6 and 7, which are placed on both sides of the plate cylinder 1, and at the same time is pivotably supported around its shaft axis 18. The adjusting shaft 11 has a hexagonal head 19 or 21 on each of its ends. Holders 22 and 23, which are screwed to the ends of the plate cylinder 1, are used to receive set screws 24 and 26. all as may be seen most clearly in FIG. 1. The set screws 24 and 26 have headed portions 27 and 28 which abut against the hexagonal heads 19 and 21 on the ends of the adjusting shaft 11. Thus, it will be seen that adjustment of the set screws 24 and 26 will shift axially slidable adjusting shaft 11 with respect to plate cylinder 1. The adjusting shaft 12 is pivotable in holders 29 and 31 which are also attached to the ends of the plate cylinder 1. However, in contrast to axially slidable adjusting shaft 11, this second adjusting shaft 12, while being rotatable in bearing rings 6 and 7, is not axially shiftable.

At the bottom 32 of the groove 2, two clamping bars 33 and 34 are disposed so as to be axially slidable and also pivotable in a vertical plane for clamping and in a horizontal plane for skewing. These three degrees of freedom are made possible by self-contained cardan or universal joints 37 and 39 which are guided and supported by two slot guides 36 and 38 that extend along the bottom 32 parallel thereto. The self-contained cardan joints 37 and 39 are each disposed centrally underneath the clamping bars 33 and 34, respectively. When it is desired to adjust the lateral or axial position of a printing plate 73 which is held on plate cylinder by clamping bars 33 and 34, this is accomplished by using adjusting screws 41, 42, 43 and 44, which are shown in FIG. 1. Adjusting screws 41 and 43 are placed at the left and right ends, respectively. of clamping bar 33 and bear against inner surfaces of bearer rings 6 and 7, while adjusting screws 42 and 44 are carried by clamping bar 34, and also bear against bearer rings 6 and 7. Rotation of these adjusting screws is accomplishable using a suitable tool.

To skew a printing plate 73 without forming any creases, it is necessary to correspondingly skew a trailing edge 72 of the plate 73 while at the same time skewing a leading edge 71 of the printing plate. To accomplish this, the axially shiftable adjusting shaft 11 is connected with the clamping bar 34 by means of two roller levers 51 and 52, which may be seen in FIG. 1. For this purpose, the adjusting shaft 11 has next to each of its hexagonal heads 19 and 21, an annular groove 46 and 47 which is engaged by a foiler 48 or 49. The followers 48 and 49 are fixed on first ends of roller levers 51 and 52. The roller levers 51 and 52 each have a bore 53 and 54, by means of which they are each centrally pivotable around a journal 56 or 57, fixed on the plate cylinder 1. At a second end, each roller lever 51 or 52 has a pivotably disposed roller 58 or 59. The rollers 58 and 59 are in constant contact with activating bolts 61 and 62 which are disposed axially slidable in bores 63 and 64 within the bearer rings 6 and 7, respectively. These activating bolts 61 and 62 provide the connection between the rollers 58 and 59 and the adjusting screws 42 and 44 of the clamping bar 34.

Each of the clamping bars 33 and 34 has a plurality of spaced tappets or tappet arms 66 and 67, respectively. These tappet arms 66 and 67 are spaced at the same distance along clamping bars 33 and 34 as are the truncated cones 13 and 14 on the adjusting hafts 11 and 12. Free ends of these tappet arms 66 and 67 ride directly on surface portions 65 and 70 of the eccentrically mounted truncated cones 13 and 14 on the adjusting shafts 11 and 12.

A narrow, vertical slot 68 or 69, for receiving the leading or trailing edge 71 or 72 of a printing plate 78 is formed in an upper part of the clamping bars 38 and 84. A plurality of pressure springs 74 are disposed in the groove 2, and are fastened with their ends on inner surfaces 76 and 77 of the clamping bars 33 and 34, thus pushing them apart in the direction of the sidewalls 3 and 4, so that the tappets 66 and 67 are kept in constant contact with the truncated cones 13 and 14.

The adjusting shafts 11 and 12 are each provided for skewing one end 71 or 72 of the printing plate 73 which is fastened on the plate cylinder 1 by means of the clamping bars 33 and 34. The pitch of the surfaces 65 of the truncated cones 13 of the adjusting shaft 11 is selected such that an axial shifting of the axially shiftable shaft 11 causes pivoting of the clamping bar 33 parallel to the bottom 6 of the groove 2 around the self-contained cardan joint 87. The surfaces 70 of the truncated cones 14 of the adjustment shaft 4 are each disposed parallel to the surfaces 65 of the opposing truncated cones 13, so that the clamping bars 31 and 34 can be pivoted and axially shifted in relation to each other in the form of a parallelogram. During an axial shift of the adjustment shaft 11, for example towards the right, the tappets 66 on clamping bar 38 slide on the surfaces 65 of the truncated cones 13, so that the first clamping bar 33 is pivoted counterclockwise around its self-contained cardan joint 37. The followers 48 and 49 are moved by, and along the annular grooves 46 and 47 and in this way pivot the roller levers 51 and 52 counterclockwise around the journals 56 and 57. The second clamping bar 34 is thus shifted toward the left, opposite to the clamping bar 33, by the rollers 58 and 59, which are disposed on the second ends of the roller levers 51 and 52. At the same time, the second clamping bar 34 is also pivoted in a counterclockwise direction and parallel to the first clamping bar 33 by the contact of its tappets 67 with the surfaces 70 of the truncated cones 14. This effects a skewing of the printing plate 73 carried on the surface of plate cylinder 1 since the ends 71 and 72 of the printing plate 73 have been moved in opposing direction to each other. At the same time, mince the first and second clamping bars 33 and 34 both pivot in the same direction, the printing plate 73 is not creased or wrinkled during this skewing.

To set the side index or axial position of the printing plate 78, the adjusting screws 41, 42, 43, and 44 which are screwed into the clamping bars 33 and 34, are turned into or out of their respective clamping bars 33 nd 84 with the aid of a suitable tool. When the adjusting screw 41 or 42 is turned out of the clamping bar 33 or 34, the former is supported on an interior sidewall of a bearer ring 6 or 7. The adjusting screw 43 or 44 on the opposite end of the clamping bar then must, after it previously had been turned in to fix the clamping bar 33 or 34, be turned out again correspondingly. The clamping bar 33 is axially restrained by means of the slot guide 36. Adjustment of the clamping bar 34 is correspondingly performed by means of the adjustment screws 43, 44 against the activating bolts 61 and 62.

Clamping of the printing plate 73. which has had its leading and trailing edges 71 and 72 inserted into the slots 68 and 69 of the clamping bars 33 and 34, is achieved by pivoting the adjusting shaft 11 or 12, depending on which end of the printing plate is to be clamped or depending on the direction of rotation of the plate cylinder 1. During pivoting of the adjusting shafts 11 or 12, the truncated cones 13 and 14, because of their eccentric disposition, act in the manner of levers on the tappets 66 or 67 of the clamping bars 33 and 34, by means of which the latter are pivoted towards the center of the groove against the compression springs 74. The clamping bars 33 and 34 are then fixed in the clamping position.

It will thus be seen that the plate clamping assembly in accordance with the present invention utilizes a first, axially shiftable, rotatable adjusting shaft with a first cooperating and axially shiftable and pivotable clamping bar in conjunction with a second, axially fixed, rotatable adjusting bar and a second clamping bar to effect printing plate skewing or axial shifting on a plate cylinder in a rotary printing machine. Axial shifting of the first adjusting shaft effects a pivoting of the first clamping bar. This axial shifting of the first adjusting shaft also effects both a pivotal motion, and an axial shifting of the second clamping bar. Both of the adjusting bars are rotatable and use the truncated cones, which are eccentrically mounted on the adjusting shafts, to effect clamping or unclamping of the ends of the printing plate which is held on the plate cylinder by the plate clamping assembly. Accordingly, this plate clamping assembly in accordance with the present invention provides a device which allows axial plate adjustment, plate skewing, and plate clamping and unclamping all in a compact assembly which requires a far narrower groove than do prior art devices.

While a preferred embodiment of a plate clamping assembly in accordance with the present invention has been fully and completely set forth hereinabove, it will be apparent to one of skill in the art that a number of changes in, for example, the overall size of the plate cylinder, the number of truncated cones and associated tappet arms, the number of springs and the like could be made without departing from the true spirit and scope of the present invention which accordingly is to be limited only by the following claims.

What is claimed is:

1. A plate clamping assembly useable to clamp and to slidably and skewably position a printing plate on a plate cylinder of a rotary printing machine, said plate clamping assembly comprising:

first and second spaced clamping bars, each of said clamping bars being axially slidable and pivotable in a groove in the plate cylinder, each of said clamping bars being adapted to receive an end of the printing plate;

first and second rotatable adjusting shafts associated with said first and second clamping bars respectively and being positioned in said groove and each having a plurality of axially spaced truncated cones said truncated cones being positioned eccentrically with respect to axes of rotation of said adjusting shafts, one of said first and second rotatable adjusting shafts being axially slidable; and means for communicating said axial sliding movement of said one of said adjusting shafts to said first and second clamping bars.

2. The plate clamping assembly of claim 1 wherein each of said first and second clamping bars includes a plurality of spaced tappets, said tappets being directly in contact with said truncated cones of said first and second associated adjusting shafts.

3. The plate clamping assembly of claim 1 wherein said means to communicate said axial sliding movement of said one of said adjusting shafts to said first and second clamping bars includes first and second roller levers having first ends in engagement with said axially slidable adjusting shaft and second ends in engagement with said second clamping bar.

4. The plate clamping assembly of claim 1 wherein each of said first and second clamping bars has a cardan joint which is supported and guided in a bottom portion of the groove to axially slide and pivot said first and second clamping bars in the groove.

5. The plate clamping assembly of claim 1 wherein said first and second axially slidable clamping bars have means for adjusting the axial positions of said first and second clamping bars in the groove.

* * * * *